United States Patent [19]

Mosby

[11] 4,103,201

[45] Jul. 25, 1978

[54] CEMENTLESS BASE INCANDESCENT LAMP

[75] Inventor: Frederick A. Mosby, Shaker Heights, Ohio

[73] Assignee: General Electric Company, Schenectady, N.Y.

[21] Appl. No.: 730,799

[22] Filed: Oct. 8, 1976

[51] Int. Cl.[2] ..... H01J 5/48; H01J 5/50

[52] U.S. Cl. ..... 313/318; 29/25.13; 313/315; 339/144 R; 339/191 L; 339/195 L

[58] Field of Search ..... 313/318, 315; 339/146, 339/191 R, 191 L, 191 M, 195 L, 144 R, 146 R; 29/25.13

[56] References Cited

U.S. PATENT DOCUMENTS

| | | | |
|---|---|---|---|
| 773,805 | 11/1904 | Miller | 339/146 |
| 2,310,237 | 2/1943 | Horn | 339/195 L |
| 2,457,789 | 12/1948 | Von Scheven | 339/195 L |
| 2,791,713 | 5/1957 | Dean | 313/318 |
| 3,148,009 | 9/1964 | Abramson | 339/191 L |
| 3,622,947 | 11/1971 | Griffin | 339/146 |

*Primary Examiner*—Saxfield Chatmon, Jr.
*Attorney, Agent, or Firm*—Paul F. Wille; Lawrence R. Kempton; Frank L. Neuhauser

[57] ABSTRACT

An incandescent lamp is disclosed in which the lamp mount is replaced with a mount which is attached to a molded glass disc having pins extending therethrough. The disc is attached to the bulb by way of a solder glass seal and the base is welded to the pins.

15 Claims, 3 Drawing Figures

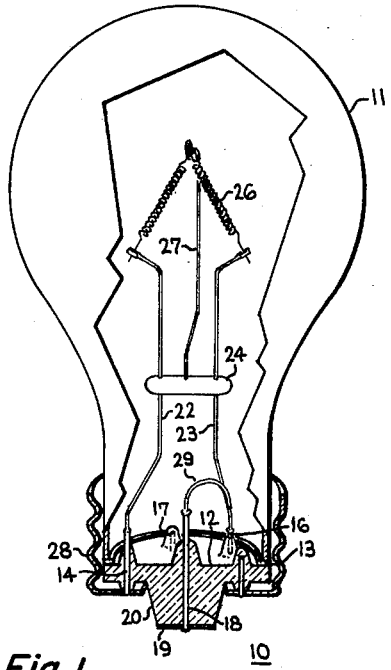
Fig. 1
Fig. 2
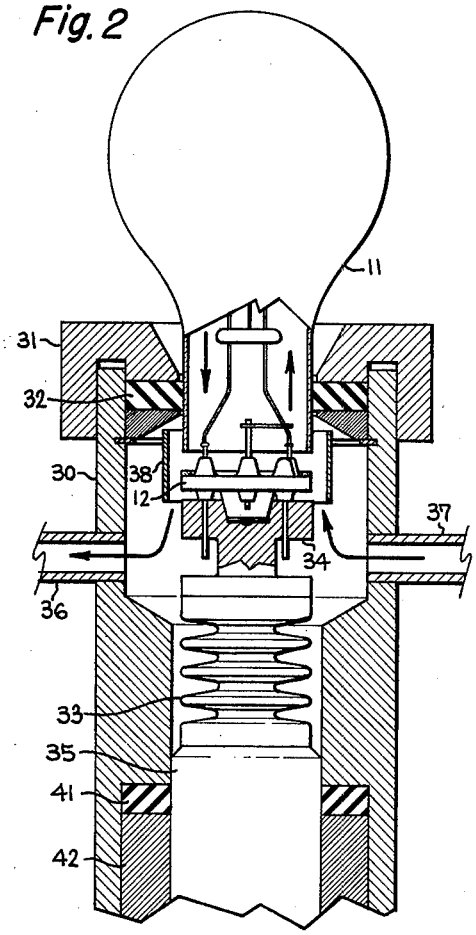
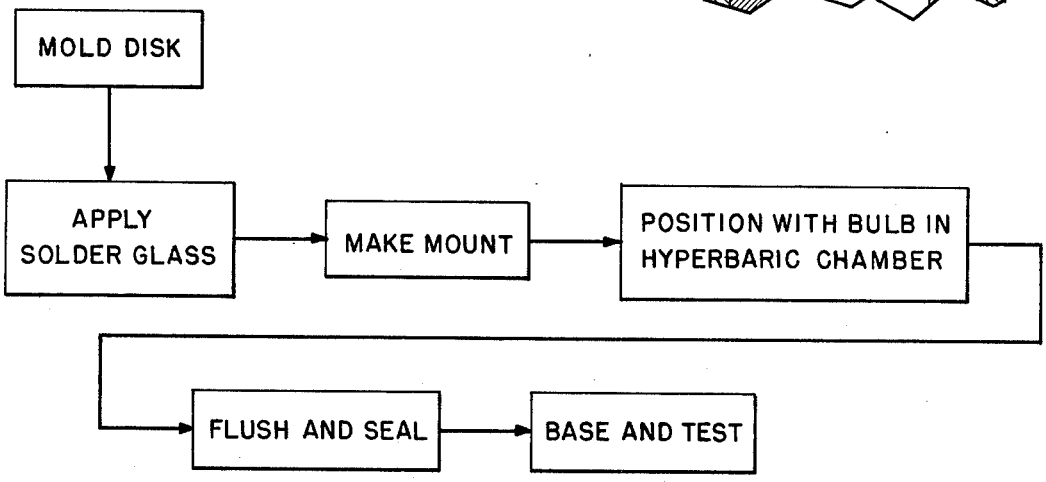
Fig. 3

CEMENTLESS BASE INCANDESCENT LAMP

BACKGROUND OF THE INVENTION

This invention relates to incandescent lamps and, in particular, to a cementless base incandescent lamp having the same external appearance as lamps having a cemented base.

In the prior art, a standard incandescent lamp contains a mount, comprising a flare, exhaust tube, lead wires, support wires held in a button formed on the inside end of the exhaust tube, and one or more filaments attached to the lead wires, sealed inside a bulb. The bulb is then shaped in the seal area for the base, flushed, filled or evacuated, and the exhaust tube sealed and cut off. The base is then attached, usually with a heat curable cement, and the lead wires connected to the base.

In general, making the mount, joining the flare, and basing require significant amounts of heat, generally supplied by gas fires. As the cost of this resource increases, the cost of making a lamp increases. In addition, basing cements have limited shelf life and introduce material handling problems in the making of a lamp.

SUMMARY OF THE INVENTION

In view of the foregoing, it is therefore an object of the present invention to simplify the construction of an incandescent lamp.

Another object of the present invention is to provide a cementless base lamp.

A further object of the present invention is to reduce the heat requirements of the lamp making process.

Another object of the present invention is to provide a new base construction for incandescent lamps which is compatible with existing sockets.

A further object of the present invention is to provide a new mount construction for incandescent lamps.

The foregoing objects are achieved in the present invention wherein a glass disc is provided with a plurality of pins extending therethrough including one through a central boss terminated in the center contact of the lamp. The lead wires are attached to the pins and any remaining pins serve only to additionally secure the base shell, to which the pins are welded or otherwise suitably fastened. The disc is attached to the envelope in a hyperbaric chamber by a solder glass seal, which may conveniently be applied to the disc prior to assembly. The hyperbaric chamber provides a suitable enclosure for the flushing and evacuation or filling of the lamp prior to sealing.

BRIEF DESCRIPTION OF THE DRAWINGS

A more complete understanding of the present invention can be obtained by considering the following detailed description in conjunction with the accompanying drawings, in which:

FIG. 1 illustrates a preferred embodiment of a lamp in accordance with the present invention.

FIG. 2 illustrates suitable apparatus for making lamps in accordance with the present invention.

FIG. 3 is a flow chart of the manufacture of lamps in accordance with the present invention.

DESCRIPTION OF THE PREFERRED EMBODIMENTS

Lamp 10 comprises envelope 11 and molded glass disc 12 attached thereto by a solder glass seal 13. Glass disc 12 is preferably molded with a plurality of pins, 14–18, positioned in bosses formed in glass disc 12. (One pin is not shown due to the cutaway.) Central boss 20, containing pin 18, is preferably enlarged on the underside of glass disc 12 thereby providing the insulator for the center contact of the lamp. Conductive disc 19 is attached to pin 18 thus forming the center contact.

Connected to pin 14 is lead wire 22. Connected to pin 16 is lead wire 23. Lead wires 22 and 23 are mechanically connected by way of insulating bridge 24 to increase the stiffness thereof in holding filament 26 which is connected therebetween. Supporting filament 26 is support 27. Support 27 is mechanically connected to lead wires 22 and 23 by way of insulating bridge 24.

The lead wires are suitably connected to pins 14 and 16, for example by welding. Connected to pins 14, 15, 17, and the pin not shown is base shell 28, which has apertures formed therein in a pattern corresponding to the positions of these pins. The pins extend from their respective bosses and are inserted through the holes in base shell 28. Central pin 18 and enlarged boss 20 (which is part of disc 12) fit through a larger, centrally located hole in base shell 28.

As is apparent from FIG. 1, pin 16 does not extend below the lower surface of disc 12 and provides a contact point for the connection of lead wire 23 to fuse 29, which interconnects pins 16 and 18. Thus, electrically, pins 14 and 18 provide contact for the filament, while the remaining pins are dummy pins serving only to provide additional fastening to the base shell or an internal connection point for the mount.

In FIG. 1, the lamp comprises five pins radially spaced from central pin 18. Of these, pin 16 does not extend below the lower surface of disc 12. Of the remainder, one is not illustrated due to the cutaway to reveal the construction of lamp 10. Pins 14, 15 and 17 fasten the base to the glass lamp and are, although not necessarily, symmetrically located from central pin 18. Obviously, for a standard three-way lamp, the fastening/contact pins may not all have the same radius from central pin 18. As is apparent to those of skill in the art, the number of fastening pins, while preferably three or more, is a matter of choice.

The materials used in constructing lamp 10 are well known in the lamp making art. For example, pins 14–18 comprise stainless steel, e.g., 27% chromium, balance iron. Leads 22 and 23 comprise nickel-plated chrome-copper, while support 27 comprises molybdenum. Base 28 may comprise brass or aluminum. The solder glass may comprise any of a number of suitable glasses and, in one embodiment of the present invention, comprises what is known as No. 1417 solder glass as is available from Corning Glass.

Solder glasses are a group of low temperature glasses developed for sealing purposes. Most conventional solder glasses are based on the properties of lead oxide and have lower melting points than common soda-lime or borosilicate glasses. They are used as a hermetic sealing or bonding agent for materials with higher melting point properties. The composition and physical properties of commercial solder glasses are provided in a wide range of thermal expansions to match the expansions of a wide variety of materials with which they can be used. The particular nature of these glasses is such that when mixed with organic vehicles they form thixotropic suspensions that allow them to be applied by dipping, spraying, screening, or extrusion.

Solder glasses fall into two general classifications; vitreous and crystallizing. Vitreous solder glasses resemble ordinary glasses because they are relatively transparent and can be reworked repeatedly with no change in characteristics or properties. They have relatively high electrical resistivities and low dielectric constants. Crystallizing solder glasses crystallize during the initial curing cycle and form a principal two-phase glass crystalline material which is generally translucent or opaque. They remain stable upon reheating even when taken to temperatures above the initial curing cycle. Crystallizing solder glasses are usually stronger than the vitreous types, and have lower electrical resistivities and higher dielectric constants.

In a preferred embodiment of the present invention, a vitreous solder glass suspended in a nitrocellulose acetate vehicle was applied by extrusion to the periphery of disc 12, cured, and heated to in excess of 450° C to fuse the glass and join envelope 11 to disc 12. By using a solder glass seal, the lamp can be sealed at a temperature which is approximately 500° C lower than the temperature required for attaching the flare to the envelope as in conventional lamp construction. Thus, the heat input required for sealing the lamp is reduced.

A more detailed understanding of the method for constructing lamps in accordance with the present invention may be obtained by considering FIGS. 2 and 3 together. FIG. 2 illustrates in cross section a portion of the apparatus utilized in making lamps in accordance with the present invention, and in particular, illustrates the hyperbaric chamber used in sealing disc 12 to envelope 11.

The hyperbaric sealing chamber comprises a suitable container such as cylinder 30 having end cap 31 attached to one end thereof. Cap 31 defines a central aperture through which the lamp parts are inserted into the hyperbaric chamber. Between cap 31 and cylinder 30 is a compression seal 32 which provides a vacuum-tight seal between the neck of the envelope of the lamp and the chamber. As known in the art, suitable means, not shown, are provided to move cap 31 relative to cylinder 30 thereby compressing seal 32. Under compression, seal 32 expands inwardly to meet the neck of the envelope and provide the vacuum seal.

Internally, the hyperbaric chamber contains bellows 33 connected to mount holder 34, which preferably comprises insulating material. The other end of bellows 33 is connected to piston 35. Strip heater 38, which may comprise a suitable resistance element, and exhaust and gas lines 36 and 37, respectively, are provided for the chamber. Encircling piston 35 is compression seal 41 which constricts under the control of movable sleeve 42 to seal the other end of the hyperbaric chamber.

The operation of the hyperbaric sealing chamber is as follows. Initially, piston 35 extends to position mount holder 34 near the aperture in cap 31. A mount, i.e., glass disc 12 complete with pins, lead wires, bridge, filament and support wire, is inserted into mount holder 34 and piston 35 retracts to position disc 12 immediately adjacent strip heater 38. Envelope 11 is then inserted through the aperture in cap 31. Seals 32 and 41 are compressed to constrict around the neck of envelope 11 and piston 35, respectively, thereby sealing the chamber.

Envelope 11 is positioned as illustrated in FIG. 2 with a slight spacing between the end of the neck and disc 12. The chamber is then evacuated by a suitable pump attached to exhaust line 36. After the chamber is evacuated, exhaust line 36 is closed and gas line 37 opened to fill the chamber and the envelope with a suitable inert gas, e.g., nitrogen. As is known in the art, this process is continued to flush and fill envelope 11. During the flushing and filling, heater 38 is turned on to heat the solder glass deposited about the periphery of glass disc 12. After the last fill, bellows 33 extends slightly to move disc 12 into contact with envelope 11. Heater 38 is shut off and the seal permitted to cool momentarily prior to removal of the lamp from the hyperbaric sealing chamber. The compression on seal 32 is released and the lamp is removed by any suitable means, not shown.

The sealed lamp is then positioned relative to a base shell and the pins extending from disc 12 are inserted into the holes in the base shell whereupon the pins are cut off and welded. This completes the assembly of a lamp in accordance with the present invention.

As apparent to those of skill in the art, the manufacture of lamps in accordance with the present invention is greatly simplified and the energy, i.e., gas fire, requirements of the lamp making apparatus is substantially less than that of the prior art. For example, in the prior art, gas fires are required during flare, stem, and mount making, bulb coating, sealing, exhausting, and basing. In contrast, lamps in accordance with the present invention only require a gas fire for fire polishing the lower portion of the neck of envelope 11 after the collet is mechanically cut off, for making glass disc 12, and for making bridge 24. Further, lamps in accordance with the present invention can be manufactured at a higher rate, as is apparent since the exhausting and filling takes place through a substantially larger area with lamps of the present invention than through the restrictive exhaust stem of lamps of the prior art.

Having thus described the invention, it will be apparent to those of skill in the art that various modifications can be made within the spirit and scope of the present invention. For example, the heat requirements of heater 38 may be reduced by preheating the envelope and disc in a warming oven prior to insertion into the hyperbaric sealing chamber. The solder glass may be applied to either or both the envelope and disc. As previously noted, while described in terms of an incandescent lamp having a single filament, more than one filament may be provided, with suitable modifications in the base shell to accommodate the multiple connections and the sockets in use for multiple filament lamps. In addition, lamps in accordance with the present invention may comprise internal diffusing or reflecting coatings and/or external coatings on the envelope. Further, the underside of the disc may have any topographical configuration, e.g., flat, except for the central boss, or comprise annular ridges containing pins 14–17 instead of individual bosses. While disc 12 is illustrated as having approximately the same diameter as the outside diameter of the neck of envelope 11, it is understood that its diameter can be slightly less than the inside diameter of the neck of envelope 11. Solder glass 13 is then applied to the outside edge rather than the upper surface of disc 12. While illustrated as having a C-2V filament, various filament geometries can be employed; e.g., CC-2V, C-6, C-8, etc.

What I claim as new and desire to secure by Letters Patent of the United States is:

1. A cementless base incandescent lamp comprising:
   a mount comprising an electrically non-conductive disc having a plurality of conductive pins, some of which extend through said disc;

a glass envelope having a neck portion;

a solder glass seal joining said disc to the end of said neck portion to form a gas-tight enclosure; and a base having a plurality of holes corresponding to the pins extending through said disc, said pins being inserted into said holes and fastened, thereby attaching the base to said lamp without the use of cement.

2. The lamp as set forth in claim 1 wherein said mount comprises:

centrally located bosses on opposite sides of said disc, wherein one of said conductive pins extends through said bosses;

a conductive disc attached to one end of said central pin and overlying one of said bosses; and wherein said disc and boss extend through a centrally located hole in said base, thereby forming the center contact for said lamp.

3. The lamp as set forth in claim 2 comprising at least three additional conductive pins radially spaced from said central pin and fastened to said base.

4. The lamp as set forth in claim 3 comprising a single filament.

5. The lamp as set forth in claim 4 wherein said filament is electrically connected to a pin extending through said disc and to a pin which does not extend through the side of said disc away from said filament, and further comprising:

a fuse element electrically connecting said pin which does not extend through said disc to said central conductive pin.

6. The lamp as set forth in claim 5 wherein said additional pins are positioned in bosses on said disc which are smaller than the boss underlying said central conductive disc.

7. The lamp as set forth in claim 1 wherein said solder glass comprises vitreous solder glass.

8. A mount for an incandescent lamp having no exhaust tube comprising:

a glass disc having centrally located bosses on opposite sides thereof;

a plurality of conductive pins, some of which extend through said disc including one through said central bosses;

a conductive disc attached to one end of said central pin and overlying one of said bosses;

at least two lead wires; and a filament connected to one end of each of two lead wires, the other ends of said lead wires being electrically connected to said central pin and another pin which extends through said disc.

9. The mount as set forth in claim 8 wherein one of said lead wires is connected to a pin which does not extend through said disc, and further comprising:

a fuse element connecting the last-named pin to one of said pins extending through said disc.

10. The mount as set forth in claim 9 wherein said fuse is connected to said central pin.

11. The method of assembling an incandescent lamp comprising the steps of:

inserting a mount comprising a glass disc in a hyperbaric chamber;

positioning the end of the neck of a glass envelope adjacent said disc;

sealing said chamber;

flushing said envelope through said neck and the space between said neck and said disc;

sealing said disc to said envelope; and attaching a base to said disc.

12. The method as set forth in claim 11 wherein said inserting step is preceded by the step of:

molding said glass disc about a plurality of pins, some of which extend through said disc.

13. The method as set forth in claim 12 wherein said molding step is followed by the step of:

applying a layer of solder glass to the periphery of said glass disc.

14. The method as set forth in claim 13 wherein said sealing step comprises:

heating said solder glass above the softening temperature thereof;

moving said disc and said envelope into contact with the solder glass therebetween; and cooling the solder glass below the softening temperature thereof.

15. The method as set forth in claim 12 wherein said attaching step comprises:

welding said base to at least some of the pins extending through said disc.

* * * * *